United States Patent [19]

Warburton et al.

[11] 4,134,353

[45] Jan. 16, 1979

[54] SLIDING CLASP FASTENER AND METHOD OF PRODUCING THE SAME

[75] Inventors: Geoffrey Warburton; Roland Parker, both of Cardiff, England

[73] Assignee: Textron Inc., Providence, R.I.

[21] Appl. No.: 752,211

[22] Filed: Dec. 17, 1976

Related U.S. Application Data

[60] Division of Ser. No. 554,033, Feb. 28, 1975, abandoned, which is a continuation of Ser. No. 306,583, Nov. 15, 1972, abandoned.

[30] Foreign Application Priority Data

Nov. 19, 1971 [GB] United Kingdom ..... 53900/71

[51] Int. Cl.[2] ..... D05B 3/12

[52] U.S. Cl. ..... 112/265; 66/195; 66/202; 24/205.16 R

[58] Field of Search ..... 66/193–195, 66/202; 24/205.16, 205.1 C

[56] References Cited

U.S. PATENT DOCUMENTS

| | | | |
|---|---|---|---|
| 3,085,410 | 4/1963 | Loizillon | 66/202 X |
| 3,314,123 | 4/1917 | Groebli | 66/193 |
| 3,490,108 | 11/1970 | Frohlich | 24/205.1 C |
| 3,490,110 | 1/1970 | Frohlich | 24/205.1 C |
| 3,540,084 | 11/1970 | Frohlich | 24/205.1 C |
| 3,685,474 | 8/1972 | Frohlich et al. | 66/193 UX |
| 3,691,796 | 9/1972 | Mayer | 66/202 |
| 3,714,683 | 2/1973 | Frohlich | 24/205.16 C |
| 3,757,541 | 9/1973 | Frohlich et al. | 66/193 |
| 3,762,002 | 10/1973 | Frohlich et al. | 66/193 UX |

*Primary Examiner*—Ronald Feldbaum
*Attorney, Agent, or Firm*—O'Brien and Marks

[57] ABSTRACT

A slide fastener with knitted tapes is manufactured by knitting the tapes, and shrinking the knitted tapes at least twenty-five percent in width, and then after shrinking, sewing fastening elements to the tapes by lines of stitches between the second and third wales.

6 Claims, 9 Drawing Figures

SLIDING CLASP FASTENER AND METHOD OF PRODUCING THE SAME

CROSS REFERENCE TO RELATED APPLICATION

This is a divisional application of pending application Ser. No. 554,033 filed Feb. 28, 1975 as a continuation application of parent application Ser. No. 306,583 filed Nov. 15, 1972 (now abandoned).

BACKGROUND OF THE INVENTION

The present invention relates to a method of manufacturing a sliding clasp fastener stringer and to a sliding clasp fastener stringer, when produced by the method.

The process of warp-knitting has been used in the manufacture of carrier tapes for sliding clasp fastener stringers, giving advantages in terms of cost, flexibility and appearance compared to such tapes when manufactured by other processes. Yarns which have been used in the process of warp-knitting include synthetic yarns, and particularly multifilament yarns.

SUMMARY OF THE INVENTION

According to the present invention there is provided a method of manufacturing a sliding clasp fastener stringer comprising the steps of warp-knitting an elongate carrier tape having a predetermined initial width, subjecting the knitted fastener tape to thermal treatment to reduce its width by at least twenty-five percent of its initial value, and then mounting a series of fastener elements along one longitudinally extending edge portion of the shrunken carrier tape.

The series of fastener elements may comprise a plurality of discrete elements, a plurality of interconnected elements, e.g. of spiral coil or meander configuration, formed from lengths of plastics or metallic material, or a plurality of individual connecting elements formed by moulding plastics material.

The fastener elements may be mounted on the carrier tape by securing them to the tape by any suitable means, for example, clamping, sewing, welding, or directly moulding on to the tape.

In a preferred embodiment of the invention the series of fastener element are secured directly or indirectly to the carrier tape by one or more lines of stitching passing through one longitudinally extending edge portion of the carrier tape.

Some at least of the fibres or threads of the carrier tape may comprise composite materials having respectively different melting points. Preferably, the carrier tape is warp-knitted incorporating yarn or fibres having a high thermal shrinkage.

Embodiments of the invention will now be more particularly described, with reference to the accompanying drawings, in which:

DESCRIPTION OF THE PREFERRED EMBODIMENT

Figure 1:
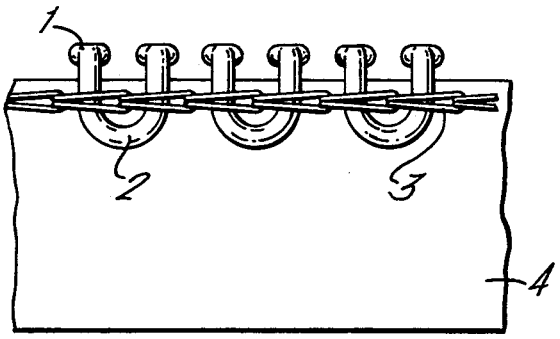
FIG. 1 shows a side elevational view of a first fastener stringer.
Figure 2:
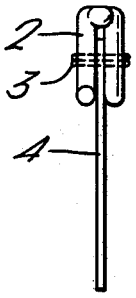
FIG. 2 shows an end elevational view of the first fastener stringer.

Referring to FIGS. 1 and 2, there is shown a meander or wendel sliding clasp fastener stringer, including a carrier tape 4, which is warp-knitted, and a series of fastener elements attached to the carrier tape by sewing a line of stitching passing through one longitudinally extending edge portion of the carrier tape 4. The stitching may comprise a single row or multiple rows of lock stitching or two thread chain stitching. The fastener elements have head portions 1 and U-shaped carrier portions 2, all the fastener elements shown in FIGS. 1 and 2 form an integral assembly, and are formed from a single strip of material. The threads forming the stitching and holding the carrier portions against the tape 4, is shown by reference numeral 3.

In the drawings, corresponding parts in each sliding clasp fastener stringer are indicated by the same reference numeral in each Figure.

Figure 3:
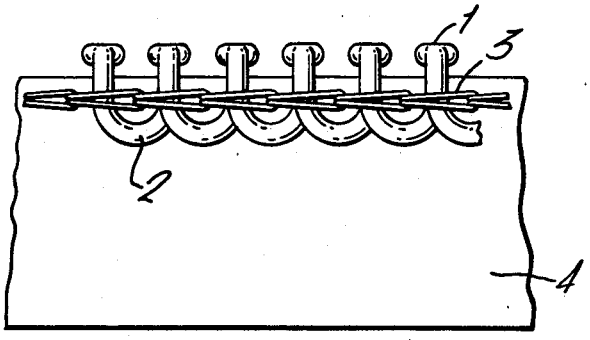
FIG. 3 shows a side elevational view of a second fastener stringer.
Figure 4:
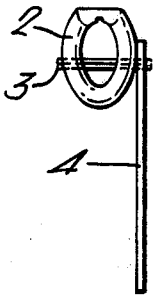
FIG. 4 shows an end elevational view of a second fastener stringer.

FIGS. 3 and 4 show a second sliding clasp fastener stringer, the fastener elements being formed from a continuous strip of material. In the stringer shown in FIGS. 3 and 4, the fastener elements are formed into a coil construction all of which is situated on one side of the carrier tape 4, as shown in the end-on elevation in FIG. 4.

Figure 5:
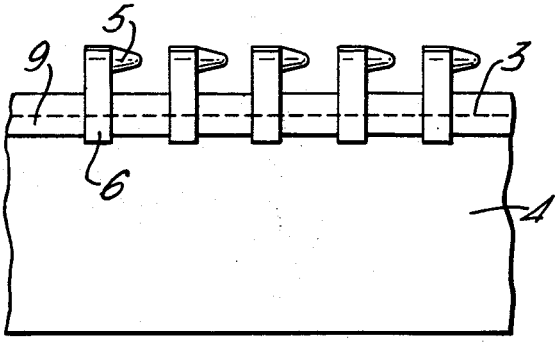
FIG. 5 shows a side elevational view of a third fastener stringer.
Figure 6:
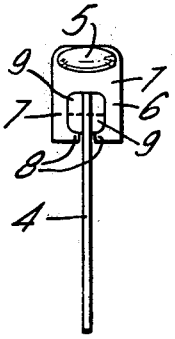
FIG. 6 shows an end elevational view of a third fastener stringer.

FIGS. 5 and 6 show the tape 4 of a slide fastener stringer having a number of metal fastener elements 6 at spaced locations along a longitudinal edge portion of the tape, each fastener element 6 having a head portion 5 and a pair of legs 7 which straddle the longitudinal edge portion of the tape 4, ending in in-turned terminal portions 8. A bend is formed along the longitudinal edge portion of the tape 4, and comprises two cords 9 attached to the tape 4 by a line of stitching, of which the position is indicated in the drawing by the broken line 3. The legs 7 and terminal portions 8 define a cavity within each fastener element 6 into which the cords 9 are received, to retain the fastener elements in position. The tape 4 may be formed of the same material as that which has been described with reference to FIGS. 1 to 4, while the fastener elements 6 are formed in the FIGS. 5 and 6 embodiment of metal or moulded plastics material.

Figure 7:
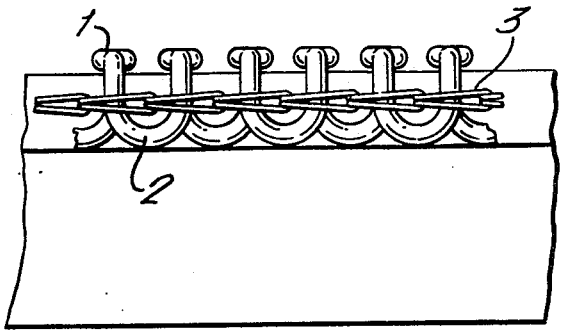
FIG. 7 shows a side elevational view of a fourth fastener stringer.
Figure 8:
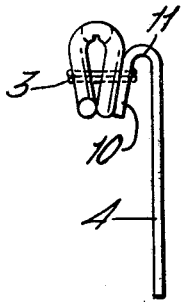
FIG. 8 shows an end elevational view of a fourth fastener stringer.

FIGS. 7 and 8 show a fastener stringer having a concealed fastener construction, and in this case the carrier tape 4 is bent over to form a second tape portion 10 connected to the main width of the tape 4 by a fold 11. Here again the stitching employed to hold the carrier portions 2 of the fastening elements in position is designated with reference numeral 3. The fastener elements are formed of one continuous length of filament or strip material formed into a meander type construction displaying a generally U-shaped cross-section, the legs of the U converging towards their free ends, as shown in FIG. 8, which is an end elevation. Alternatively, the fastener elements could be in the form of a coil of suitable cross-section.

In all the above described embodiments, the carrier tape 4 is formed by the process of warp-knitting.

Figure 9:
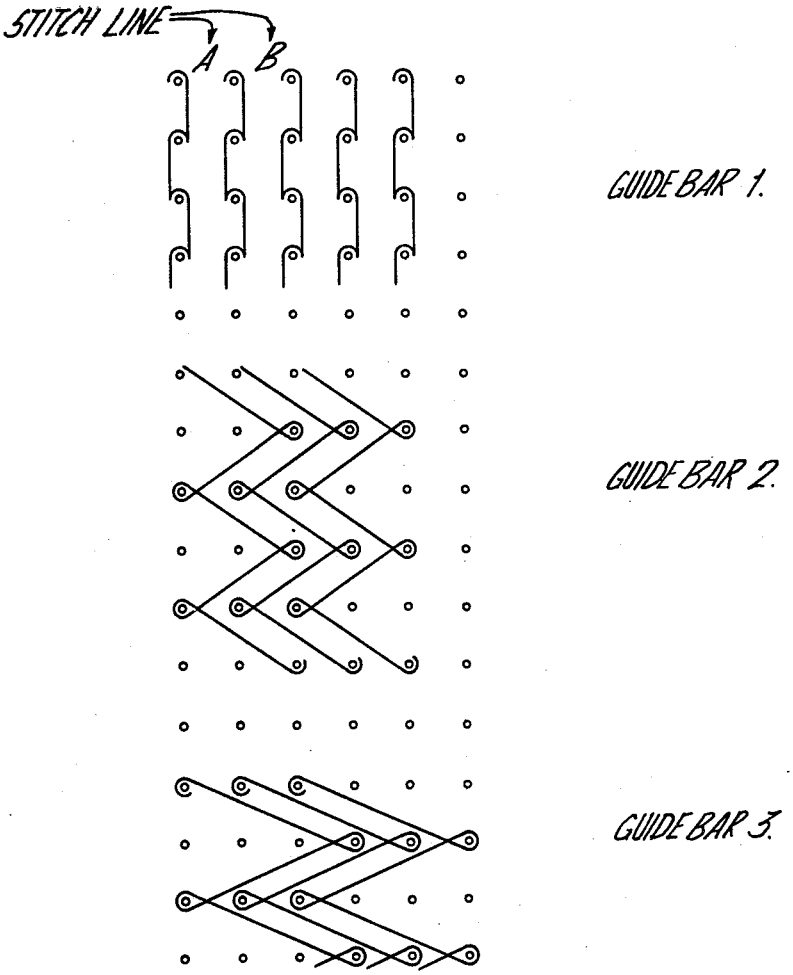
FIG. 9 shows schematically a knitting pattern which can be employed in the present invention.

The material selected for producing the carrier tape 4 in FIGS. 1 to 8 is preferably a yarn having a high thermal shrinkage, such as TREVIRA type NN high tenacity filament yarn from HOECHST Ltd. United Kingdom; for example, TREVIRA filament yarn 67 denier, 24 ends, 20 twists per meter and type NN. A number of different knitting patterns may be employed in the production of the tape. FIG. 9 shows schematically one form of suitable knitting pattern which can be executed using a three bar warp knitting machine. This particular knitting pattern gives a high degree of lateral strength and stability to the carrier tape formed by this process. The upper portion of FIG. 9 shows the stitch pattern produced by the first guide bar of the knitting machine, the central portion produced by the second guide bar, and the lower portion that produced by the third guide bar.

Before any sewing operations are carried out on the knitted tape, such as for attaching cords or fastener elements to the tape, the tape is subjected to thermal treatment to shrink the tape. This thermal treatment results in a closer packing of the various yarn strands forming the tape as a whole, making possible the execution of a line of stitches, to hold a cord or fastener element in position, between the second and third wales, rather than between the first and second wales as is normally done in prior art methods, while at the same time the distance of this line of stitches from the nearest longitudinal edge of the tape is maintained at substantially the same value. As shown in FIG. 9, when stitches are executed between the second and third wales, i.e. along the line B in FIG. 9, an added number of laterally extending yarn ends are available in this position, as compared with those available in the case of a line of stitching between the first and second wales as represented by the line A in FIG. 9. Thus the strength of attachment to the tape of a cord or fastener element when sewn on the tape by stitches along line B is far greater than when sewn by stitches along line A. A weakness of the selvedge is characteristic commonly found in prior art carrier tapes, and contributing to poor fastener performance if the line of sewing attachment is along the line A. However, with the presently described embodiments the compacting of the first and second wales permits the use of sewing line B, thus overcoming the above weakness. In applications other than the use in slide clasp fasteners, this weakness of selvedge will be of limited importance. It is, however, of considerable importance in the attachment of cords and fastener elements to tapes, especially where warp-knitting is used.

Whilst there may be alternative methods of improving the strength of the selvedge by individual ends of heavier denier yarn, weft inlay, or utilising increased numbers of guide bars, the use of high thermal shrinkage and knitting patterns similar to the one described achieve the required result in a simpler manner.

Particularly good results are given by the above described process when the yarn has a possible thermal shrinkage such as to diminish the width during a shrinking step by over 30%. A shrinkage in excess of 25% is preferred from the point of view of mechanical stability.

Three particular advantages of the described process are as follows:

(a) A coarser gauge of machine can be used, allowing heavier denier yarns to be employed in the process;

(b) the interlocking of the knitted stitches or loops is greatly improved, thus contributing to the prevention of "windowing" or "reeding" of the tape when the fastener elements are subjected to lateral load;

(c) the selvedge or outer wale of a knitted tape tends to be weaker than the remainder of the tape, owing to the number of weft-wise threads in the selvedge usually being smaller than the number of wales in the body of the tape. With the described method, however, the attachment of fastener elements by sewing can be improved greatly by using a stitching line shown at B in FIG. 9, rather than that shown at A, as described above. Greater lateral strength and improved life of the fastener are thus achieved.

In any of the described embodiments incorporating fastener elements of continuous filament or strip, reinforcing cords may be included, this being particularly applicable to the embodiment shown in FIGS. 3 and 4. For example, with reference to the FIGS. 3 and 4 embodiment, a reinforcing cord, such as a cord of textile material, may extend throughout the axial length of the coil construction, or any part of that length, the most convenient position for such a cord being within the coil itself.

What is claimed is:

1. A method of manufacturing a sliding clasp fastener stringer comprising the steps of:

warp knitting an elongate carrier tape of a yarn having a high thermal shrinkage, the tape having a predetermined initial width, and said warp knitting including the forming of a plurality of spaced wales extending longitudinally in the tape;

subjecting said tape to thermal treatment to reduce the width of said tape by at least twenty-five percent of said predetermined initial width, to increase interlocking of the knitted loops in the carrier tape, and to pack the yarn thereof closer; and then mounting a series of fastener elements on one edge portion along one longitudinally extending edge of said carrier tape;

said mounting including the forming of a longitudinal line of stitching on said one edge portion positioned inward from the one edge of the tape by more than the width of first and second wales of said plurality of wales on the one edge of the tape.

2. A method as defined in claim 1, wherein said forming of the line of stitching on said one edge portion of said carrier tape secures said series of fastener elements directly to said one edge portion of said carrier tape.

3. A method as defined in claim 1, wherein said forming of the line of stitching on said one edge portion of said tape secures at least one cord of material thereto; and said mounting step includes assembling said series of fastener elements on said at least one cord.

4. A method as defined in claim 2 wherein said line of stitching is sewn between the second and third wales from said one tape edge.

5. A method as defined in claim 3 wherein said line of stitching is sewn between the second and third wales from said tape edge.

6. A method as defined in claim 1, wherein said thermal treatment causes said tape to shrink to such an extent that the spacing between said one tape edge and a line extending mid-way between the first and second wales from said tape edge, when said tape is in its initial state, is substantially equal to the spacing between said one tape edge and a line extending mid-way between the second and third wales from said tape edge when said tape is in its shrunken state.

* * * * *